US007334372B2

(12) United States Patent
Evans et al.

(10) Patent No.: US 7,334,372 B2
(45) Date of Patent: Feb. 26, 2008

(54) TOP FLANGE HANGER WITH STRENGTHENING EMBOSSMENT

(75) Inventors: Thomas G. Evans, Dublin, CA (US); Tawn Simons, Brentwood, CA (US); Jin-Jie Lin, Livermore, CA (US)

(73) Assignee: Simpson Strong-Tie Co., Inc., Pleasanton, CA (US)

( * ) Notice: Subject to any disclaimer, the term of this patent is extended or adjusted under 35 U.S.C. 154(b) by 325 days.

(21) Appl. No.: 10/966,006

(22) Filed: Oct. 15, 2004

(65) Prior Publication Data

US 2006/0081743 A1 Apr. 20, 2006

(51) Int. Cl.

| | |
|---|---|
| ***E04B 1/00*** | (2006.01) |
| ***E04B 5/00*** | (2006.01) |
| ***E04B 7/00*** | (2006.01) |
| ***E04B 1/38*** | (2006.01) |
| ***E04B 7/04*** | (2006.01) |
| ***E04C 5/00*** | (2006.01) |
| ***E04H 12/00*** | (2006.01) |

(52) U.S. Cl. ..... 52/289; 52/702; 52/698; 52/92.2; 52/655.1; 52/650.3

(58) Field of Classification Search ..... 52/702, 52/712, 92.1, 92.2, 733.5, 655.1, 650.3, 698
See application file for complete search history.

(56) References Cited

U.S. PATENT DOCUMENTS 414,169 A 10/1889 Reuschel
478,163 A 7/1892 Lehman
508,280 A 11/1893 Cavallaro (Continued)

FOREIGN PATENT DOCUMENTS

GB 1 431 122 4/1976

(Continued)

OTHER PUBLICATIONS

"Top Flange Hangers JB/LB/B/HB/HHB/GB/HGB/BI/LBV/HBI *Joist, Beam and Purlin Hangers*," Simpson Strong-Tie Connectors Wood Construction Connectors catalog C-2000, Simpson Strong-Tie Co., Inc. Pleasanton CA. 1999 front and back cover pages and p. 56.

(Continued)

*Primary Examiner*—Richard E. Chilcot, Jr.
*Assistant Examiner*—Hunter M Dreidame
(74) *Attorney, Agent, or Firm*—Law Offices of James R. Cypher

(57) ABSTRACT

A structural connector for connecting first and second structural members has a substantially planar first flange and an embossment in the first flange, and the embossment in the first flange is formed with first and second sections, the first section generally extending uniformly to a first level above the top surface of the substantially planar first flange, that is different from a level to which the second section generally uniformly extends, the first and second sections being joined to each other at a distinct transition portion where the embossment sharply descends from the level of the first section to the level of the second section. The structural connector can be made with a bend that forms a first member adjacent the first flange and the embossment can extend through the bend into the first member.

31 Claims, 7 Drawing Sheets

U.S. PATENT DOCUMENTS 546,147 A 9/1895 Gregg
625,427 A 5/1899 Stewart et al.
666,918 A 1/1901 Butz
753,053 A 2/1904 Eberhardt
755,116 A * 3/1904 Dreyer ..... 403/68
770,050 A * 9/1904 Dreyer et al. ..... 403/190
783,807 A * 2/1905 Tuteur ..... 403/232.1
804,451 A * 11/1905 Carlson ..... 52/702
832,133 A 10/1906 Lanz
924,842 A * 6/1909 Seipp ..... 403/190
1,097,934 A 5/1914 Price
1,720,104 A 7/1929 Taylor et al.
2,500,636 A 3/1950 Isakson
D160,928 S 11/1950 D'Aleo
3,000,145 A 9/1961 Fine
3,036,347 A 5/1962 Findleton
3,137,922 A 6/1964 Schumacher
3,222,831 A 12/1965 Pritchard
3,332,188 A 7/1967 Schaefer
3,365,222 A 1/1968 Polyak
3,394,573 A 7/1968 Bodnar
3,422,585 A 1/1969 Dismukes
3,586,565 A 6/1971 Fielding
3,601,428 A 8/1971 Gilb
3,633,950 A 1/1972 Gilb
3,703,304 A 11/1972 Losee
3,752,512 A 8/1973 Gilb
3,972,169 A 8/1976 Sheppard, Jr.
4,005,942 A * 2/1977 Gilb ..... 403/189
4,074,495 A 2/1978 Bodnar
4,198,175 A 4/1980 Knepp et al.
4,291,996 A 9/1981 Gilb
4,343,580 A 8/1982 Moyer et al.
4,408,262 A 10/1983 Kusmer
4,411,548 A * 10/1983 Tschan ..... 403/232.1
4,417,431 A 11/1983 Commins et al.
4,423,977 A 1/1984 Gilb
4,480,941 A * 11/1984 Gilb et al. ..... 403/232.1
4,569,451 A 2/1986 Parrott et al.
4,576,280 A 3/1986 Dove et al.
4,594,017 A 6/1986 Hills
4,802,786 A 2/1989 Yauger et al.
4,854,096 A 8/1989 Smolik
4,893,961 A 1/1990 O'Sullivan et al.
4,920,725 A * 5/1990 Gore ..... 52/702
4,932,173 A 6/1990 Commins
4,982,548 A 1/1991 Abbey
4,995,206 A 2/1991 Colonias et al.
5,104,252 A 4/1992 Colonias et al.
5,203,132 A 4/1993 Smolik
5,217,317 A 6/1993 Young
5,297,886 A 3/1994 Jansen et al.
5,367,853 A 11/1994 Bryan
5,385,433 A * 1/1995 Calandra et al. ..... 405/302.1
5,394,665 A 3/1995 Johnson
5,394,668 A 3/1995 Lim
5,401,002 A 3/1995 Major
5,481,844 A 1/1996 Kajita
5,555,694 A * 9/1996 Commins ..... 52/702
5,560,156 A 10/1996 McDonald
5,564,248 A * 10/1996 Callies ..... 52/702
5,603,580 A * 2/1997 Leek et al. ..... 403/232.1
5,620,275 A 4/1997 Novacek
5,836,131 A 11/1998 Viola et al.
5,930,968 A 8/1999 Pullam
5,938,366 A 8/1999 Novacek
5,941,044 A 8/1999 Sera
5,961,084 A 10/1999 Brand et al.
5,979,130 A 11/1999 Gregg et al.
6,012,262 A 1/2000 Irving
6,085,482 A 7/2000 Jalla
6,088,982 A 7/2000 Hiesberger
6,260,402 B1 * 7/2001 Leek ..... 72/379.2
6,397,552 B1 6/2002 Bourque
6,508,447 B1 1/2003 Catani et al.
6,523,321 B1 * 2/2003 Leek et al. ..... 52/702
6,543,735 B1 4/2003 Haynes et al.
6,604,326 B1 8/2003 Noble
6,607,086 B1 8/2003 Gretz
6,698,971 B1 3/2004 Wilhelmi
6,807,790 B2 10/2004 Strickland et al.
6,817,157 B2 11/2004 Bourque
6,840,020 B2 1/2005 Leek et al.
6,877,291 B2 * 4/2005 Shamroukh et al. ..... 52/702
6,931,813 B2 8/2005 Collie
7,065,932 B2 * 6/2006 Roesset et al. ..... 52/712
2001/0010167 A1 * 8/2001 Leek ..... 72/379.2

FOREIGN PATENT DOCUMENTS

GB 2 156 398 10/1985
GB 2 163 788 3/1986
GB 2 176 222 12/1986
GB 9916839.5 7/1999
GB 2 354 267 3/2001
WO WO 90/10765 9/1990
WO WO 01/06068 1/2001

OTHER PUBLICATIONS

"Top Flange Hangers JB/LB/B/HB/HHB *Joist, Beam and Purlin Hangers*," Simpson Strong-Tie Connectors Wood Construction Connectors catalog C-2003, Simpson Strong-Tie Co., Inc., Dublin, CA. 2002, front and back cover pages and p. 54.

"HUTF/HUSTF *Heavy Duty and Double Shear Joist Hangers*," Simpson Strong-Tie Connectors Wood Construction Connectors catalog C-2003, Simpson Strong-Tie Co., Inc., Dublin, CA. 2002, front and back cover pages and p. 54.

"Top Flange Hangers JB/LB/B/HB/HHB/GB/HGB/BI/LBV/HBI *Joist, Beam and Purlin Hangers*," Simpson Strong-Tie Connectors Wood Construction Connectors catalog C-2000, front and back cover pages and p. 56. Simpson Strong-The Co., Inc. Pleasanton CA. 1999.

"Top Flange Hangers JB/LB/B/HB/HHB *Joist, Beam and Purlin Hangers*," Simpson Strong-Tie Connectors Wood Construction Connectors catalog C-2003, front and back cover pages and p. 54. Simpson Strong-Tie Co., Inc., Dublin, CA.

"HUTF/HUSTF *Heavy Duty and Double Shear Joist Hangers*," Simpson Strong-Tie Connectors Wood Construction Connectors catalog C-2003, front and back cover pages and p. 54. Simpson Strong-Tie Co., Inc., Dublin, CA. 2002.

"Top Flange Hangers W/WPU/WNP/WM/WMU/HW/HWU," Simpson Strong-Tie Connectors Wood Construction Connectors catalog C-2003, Simpson Strong-Tie Co., Inc., Dublin, CA. 2002, front and back cover pages and p. 55.

"Top Flange Hangers HHB/GB/HGB *Beam and Purlin Hangers*," Simpson Strong-Tie Connectors Wood Construction Connectors catalog C-2003, Simpson Strong-Tie Co., Inc., Dublin, CA. 2002, front and back cover pages and p. 101.

"Top Flange Hangers WPU/WNP/HW/HWU," Simpson Strong-Tie Wood Construction Connectors catalog C-2003, Simpson Strong-Tie Co., Inc., Dublin, CA. 2002, front and back cover pages and p. 101.

"Top Flange Hangers ITT/MIT/HIT/ITTM *Composite Wood Products Hangers*," Simpson Strong-Tie Wood Construction Connectors catalog C-2004, Simpson Strong-Tie Co., Inc., Dublin, CA. 2003, front and back cover pages and p. 78.

"Top Flange Hangers LBV/B/BI/HB/HBI," Simpson Strong-Tie Wood Construction Connectors catalog C-2004, Simpson Strong-Tie Co., Inc., Dublin, CA. 2003, front and back cover pages and p. 80.

"Top Flange Hangers W/WP/WPU/WM/WMU/HW/HWU *I-Joist and Structural Composite Lumber Hangers*," Simpson Strong-Tie Wood Construction Connectors catalog C-2004, Simpson Strong-Tie Co., Inc., Dublin, CA. 2003, front and back cover pages and p. 81.
"THA/THAC *Adjustable Truss Hangers*," Simpson Strong-Tie Connectors Catalog C-2003, Simpson Strong-Tie Company, Inc. Dublin, Ca, 2002, front and back cover pages, p. 62, and 108.
"HF26N/F *Panelized Construction Hangers*," Simpson Strong-Tie Connectors Catalog C-2003, Simpson Strong-Tie Company, Inc. Dublin, Ca, 2002, front and back cover pages and p. 59.
"PF *Post Frame Hangers*," Simpson Strong-Tie Connectors Catalog C-2003, Simpson Strong-Tie Company, Inc. Dublin, Ca, 2002, front and back cover pages and p. 59.
"IUS/IUT/MIU I *Joist Hangers*," Simpson Strong-Tie Connectors Catalog C-2003, Simpson Strong-Tie Company, Inc. Dublin, Ca, 2002, front and back cover pages and p. 66.
"Face Mount Hangers-I-Joists," Simpson Strong-Tie Connectors Catalog C-2003, Simpson Strong-Tie Company, Inc. Dublin, Ca, 2002, front and back cover pages and pp. 68-70.
"THAI I *Joist and Structural Composite Lumber Hangers*," Simpson Strong-Tie Connectors Catalog C-2003, Simpson Strong-Tie Company, Inc. Dublin, Ca, 2002, front and back cover pages and p. 78.
"GLTV/HGLTV *Heavy Duty Hangers,*" Simpson Strong-Tie Connectors Catalog C-2003, Simpson Strong-Tie Company, Inc. Dublin, Ca, 2002, front and back cover pages and p. 79.
"Top Flange Hangers—I-Joist & SCL," Simpson Strong-Tie Connectors Catalog C-2003, Simpson Strong-Tie Company, Inc. Dublin, Ca, 2002, front and back cover pages and pp. 84-93.
"Top Flange Hangers GLS/HGLS/GLT/HGLT," Simpson Strong-Tie Connectors Catalog C-2003, Simpson Strong-Tie Company, Inc. Dublin, Ca, 2002, front and back cover pages and p. 99.
"Top Flange Hangers—Glulam Beam," Simpson Strong-Tie Connectors Catalog C-2003, Simpson Strong-Tie Company, Inc. Dublin, Ca, 20032, front and back cover pages and p. 100.
"Top Flange Hangers LEG/MEG/EG," Simpson Strong-Tie Connectors Catalog C-2003, Simpson Strong-Tie Company, Inc. Dublin, Ca, 2002, front and back cover pages and p. 99.
"WPT/WNPPT/WMPT *Planted Truss Top Flange Hangers*," Simpson Strong-Tie Connectors Catalog C-2003, Simpson Strong-Tie Company, Inc. Dublin, Ca, 2002, front and back cover pages and p. 106.
"Top Flange Hangers—Plated Truss," Simpson Strong-Tie Connectors Catalog C-2003, Simpson Strong-Tie Company, Inc. Dublin, Ca, 2002, front and back cover pages and p. 107.
"MSC *Multiple Seat Connector*," Simpson Strong-Tie Connectors Catalog C-2003, Simpson Strong-Tie Company, Inc. Dublin, Ca, 2002, front and back cover pages and p. 63.
"Top Flange Hangers W/WPU/WNP/WM/WMU/HW/HWU," Simpson Strong-Tie Connectors Catalog C-2003, Simpson Strong-Tie Company, Inc. Dublin, Ca, 2002, front and back cover pages and p. 55.
"Top Flange Hangers—Solid Sawn Lumber (DF/SP)," Simpson Strong-Tie Connectors Catalog C-2003, Simpson Strong-Tie Company, Inc. Dublin, Ca, 2002, front and back cover pages and p. 56-58.
"Top Flange Hangers W/WP/WPU/WM/WMU/HW/HWU *I-Joist and Structural Composite Lumber Hangers*," Simpson Strong-Tie Connectors Catalog C-2002, Simpson Strong-Tie Company, Inc. Dublin, Ca, 2003, front and back cover pages and p. 77.
"Top Flange Hangers—I-Joist & SCL," Simpson Strong-Tie Connectors Catalog C-2003, Simpson Strong-Tie Company, Inc. Dublin, Ca, 20032, front and back cover pages and p. 80-93.
"WM/WMI/WMU *Hangers*," Simpson Strong-Tie Connectors Catalog C-2003, Simpson Strong-Tie Company, Inc. Dublin, Ca, 2002, front and back cover pages and p. 120.
"MBHA Masonry Hangers," Simpson Strong-Tie Connectors Catalog C-2003, Simpson Strong-Tie Company, Inc. Dublin, Ca, 20032, front and back cover pages and p. 121.
"CC *Column Caps*," Simpson Strong-Tie Connectors Catalog C-2003, Simpson Strong-Tie Company, Inc. Dublin, Ca, 2002, front and back cover pages and p. 42.
"ECC/ECCU *Column Caps*," Simpson Strong-Tie Connectors Catalog C-2003, Simpson Strong-Tie Company, Inc. Dublin, Ca, 2002, front and back cover pages and p. 43.
"THASR/L *Adjustable Truss Hangers*," Simpson Strong-Tie Connectors Catalog C-2004, Simpson Strong-Tie Company, Inc., Dublin, Ca 2003, front and back cover pages and p. 106.
"Top Flange Hangers—I-Joist & SCL," Simpson Strong-Tie *Wood Construction Connectors* catalog C-2005, Simpson Strong-Tie Company, Inc., Dublin, Ca, 2004, front and back cover pages and p. 99.

* cited by examiner

TOP FLANGE HANGER WITH STRENGTHENING EMBOSSMENT

BACKGROUND OF THE INVENTION

This invention relates to a structural connector for attaching two structural members together in a structure such as a building, the structural connector having a two-tiered embossment formed in at least one of the members of the connector to strengthen the connector.

The structural connector of the present invention has particular application in the field of structural hangers where an elongated, generally horizontally disposed structural member is hung from a supporting structure, both being part of the structural frame of a building.

In light frame construction, it is common to hang the joists supporting the floors of the building from horizontally disposed members often called headers, beams or ledgers. The joists can be supported by hangers which are attached to the headers, beams or ledgers. One type of hanger used is called a top flange hanger. A top flange hanger has a portion or member that rests on the top surface of the supporting structure, increasing the strength of the connection.

Unfortunately, the presence of the top flange can interfere with the setting of the sub-flooring members on top of the joists and the headers and ledgers. The top flanges create an unevenness in the surface upon which the sub-flooring is installed.

Preferably, the flat top surfaces of the joists, headers and ledgers will all be uniformly level and set at the same elevation, once the members are set in place, although deviations are often made to allow for shrinkage of members made from wood or having wood sub-components. Also, preferably, the sub-flooring used is made up of large sheets of relatively thin planar material, such as plywood or oriented strand board, that can be laid down on the level top surfaces of the headers and ledgers resulting in a uniformly flat surface for laying down the flooring.

Thus, it is desirable to minimize the thickness of any members, such as fasteners, fastener heads or hanger components that will project above the level of the top surfaces of the ledges, headers and joists. When such members project above the ultimate top level of the structural members of the flooring, they create unevenness in the surface for the subflooring, commonly known as reveal problems.

Thus, when top flange hangers are used, it is desirable to make the material of the top flange as thin as possible. However, the top flange must still be strong enough to carry the desired loads imposed on the hanger. One means of strengthening the top flanges of hangers is to create embossments or deformations in the top flange hanger that extend into the back members of the hangers. The problem with typical strengthening deformations or embossments is that too much of the material of the top flange is deformed to too great a height, thus creating reveal problems.

SUMMARY OF THE INVENTION

The present invention provides a strengthening embossment made in a first member or flange of a structural connector, where along the length of the embossment, the embossment is stepped so that it extends to different heights from the member from which it is formed to create progressive or differentiated stiffening along the member.

The present invention also provides a strengthening embossment made in a pair of first and second members or flanges of a structural connector, where the first and second members are joined at a bend line and the strengthening embossment extends from one member to the second member through the bend, and along the length of the embossment, the embossment is stepped so that it extends to different heights from at least one of the members from which it is formed.

A structural connector made according to the present invention has a substantially thin, first flange which has a top surface that has at least a portion that is substantially planar. The first flange is in operative connection with a first structural member such that forces imposed on the first flange can be transmitted to the first structural member. A structural connector made according to the present invention also has a first member that is in operative connection with a second structural member and the first flange such that forces imposed on the second structural member are transmitted to the first member, and through the first member and then to the first flange, and through the first flange to the first structural member. The first flange is integrally connected to and differentiated from the first member at a first bend between the first flange and the first member. A structural connector made according to the present invention has an embossment in the first flange that extends through the first bend into the first member, and the embossment in the first flange is formed with first and second sections, the first section generally extending uniformly to a first level above the top surface of the substantially planar first flange, that is different from a level to which the second section generally uniformly extends, the first and second sections being joined to each other at a distinct transition portion where the embossment descends from the level of the first section to the level of the second section. It is preferable that the transition portion be abrupt so that the first section sharply descends to the level of the second section. This makes the transition section easily visible which allows parts to be checked to make sure that the deep section extends far enough to provide sufficient rigidity to the part, but does not extend too far to create reveal problems.

It is a specific object of the present invention to provide a structural hanger for supporting a structural member from a supporting member, where the structural hanger is made with a top flange that rests on the top surface of the supporting member, and the top flange of the hanger is formed with strengthening deformations that increase the strength of the structural hanger while minimizing the profile of the top flange of the hanger.

It is a further object of the present invention to provide a structural hanger for supporting a structural member from a supporting member, where the structural hanger is made with a pair of top flanges that rest on the top surface of the supporting member, and the top flanges of the hanger are formed with strengthening deformations that increase the strength of the structural hanger while minimizing the profile of the top flanges of the hanger.

It is a further object of the present invention to provide that the level of the first section of the embossment of the structural connector is higher above the top surface of the first flange than the level of the second section of the embossment, and the higher first level is closer to the bend between the first flange and the first member than the second section. The inventors have found embossments which are taller near the edge of the first structural member or supporting structural member and then decrease in height but continue to extend a substantial distance along the top flange, can provide sufficient strength to structural hangers made from light gauge steel, while providing minimal interference with the laying of the subflooring.

It is a further object of the present invention to provide a top flange hanger with a two-tiered or stepped embossment that strengthens the top flange and extends the length of the top flange or substantially the length of the top flange.

It is a further object of the present invention to provide a connector that is attached to the structural members it connects with headed fasteners such as nails or bolts, and when connected using those fasteners, the shanks of the fasteners are received by the connector and the structural members and the heads of the fasteners interface with and against the connector, and in the portions of the connector that also have the two-tiered embossment of the present invention the top surfaces of the heads of the fasteners do not extend substantially above, and preferably are at the same level or below, the highest level of the deepest section of the embossments of the present invention.

A further object of the present invention is to provide a top flange hanger with low-profile strengthening deformations in its top flange or flanges that can be formed from sheet steel material on a fully automated die press with no secondary or final bend operations being necessary.

It is a further object of the present invention to provide a top flange hanger made from galvanized sheet steel or stainless steel that does not need to be welded, and, therefore, does not need to be painted to protect the hanger from corrosion.

DETAILED DESCRIPTION OF THE PREFERRED EMBODIMENT

Figure 1:
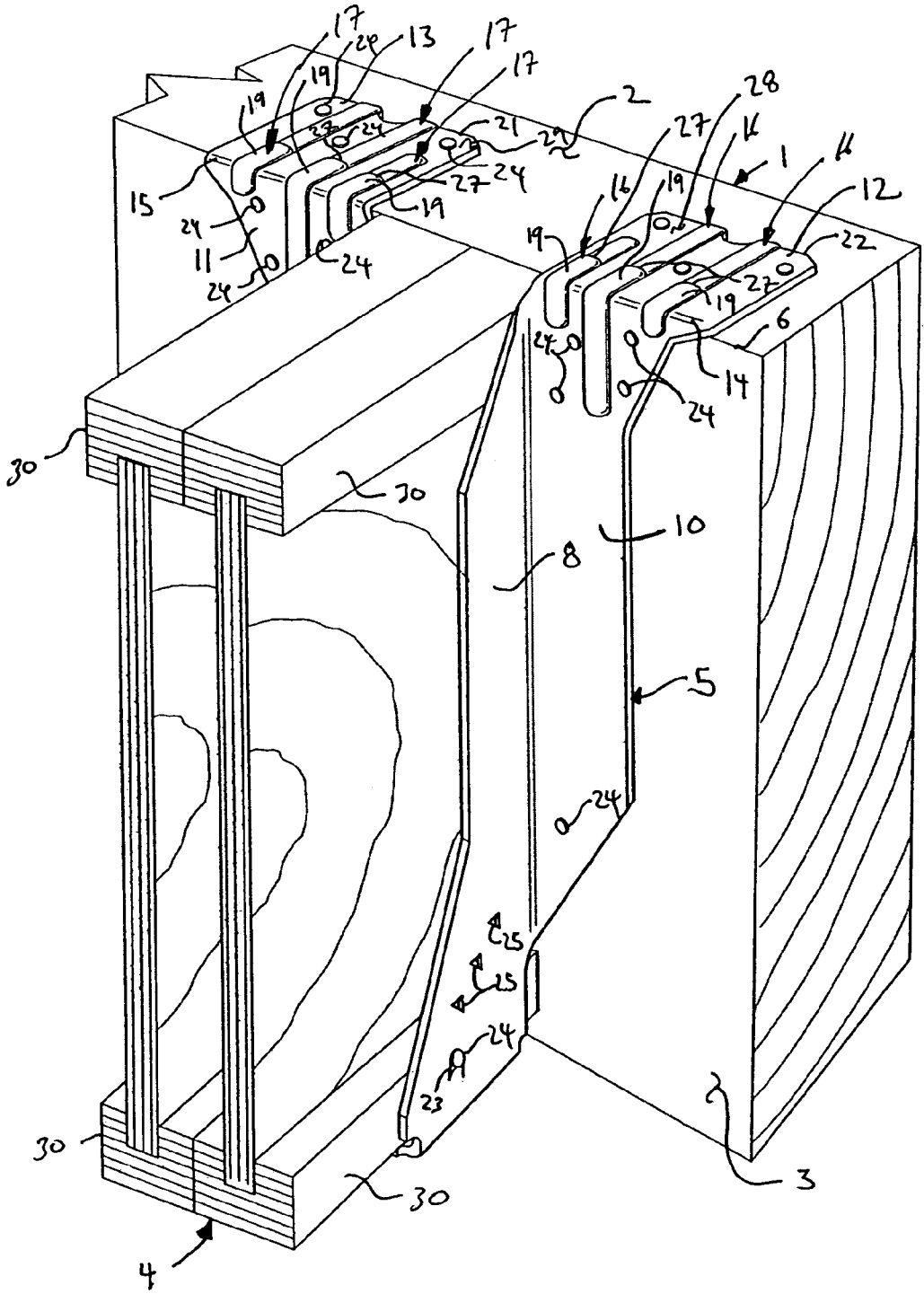
FIG. 1 is a perspective view of the structural hanger of the present invention mounted on a supporting structure, and holding a supported structure—a pair of I-Joists.

As shown in FIG. 1, in the preferred embodiment of the present invention, a supporting structure or first structural member 1 having a top surface 2 and a front face 3 supports a supported structure or second structural member 4 disposed at an angle to the front face 3 of the supporting structure 1 by means of a structural hanger 5. In the present invention, the top surface 2 and the front surface 3 of the supporting structure meet at an edge 6.

As shown in FIG. 1, in the preferred embodiment of the present invention, the structural hanger 5 is formed with a seat member 7 that receives the supported member 4, and provides a bearing surface for the supported member 4.

Figure 2:
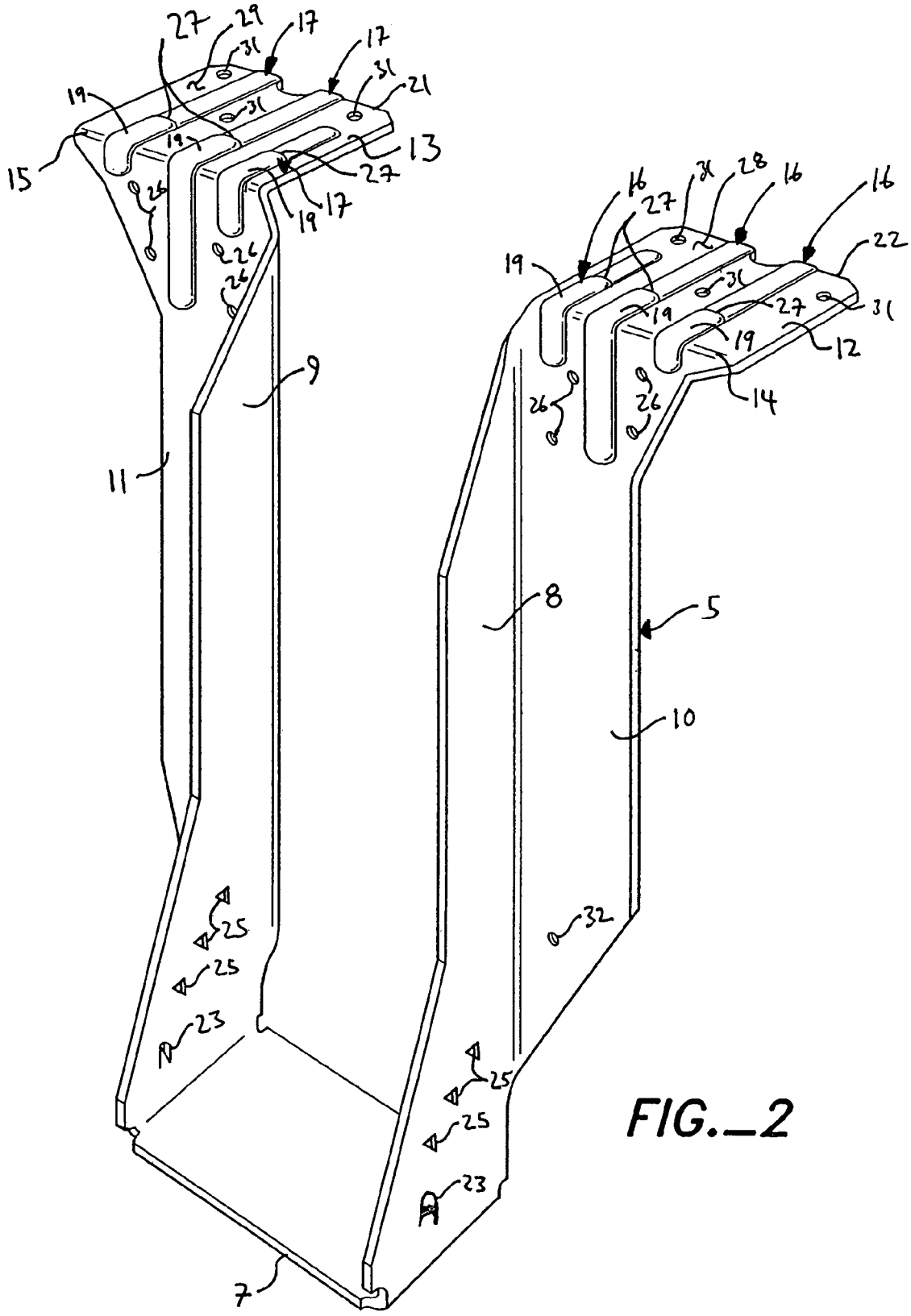
FIG. 2 is a perspective view of the structural hanger of the present invention.

As shown in FIG. 2, also in the preferred form of the invention, the structural hanger 5 is formed with laterally spaced first and second side members 8 and 9 that are connected to the seat member 7 and stabilize the supported member 4, by interfacing with it. In the preferred form of the invention, the side members 8 and 9 support the seat member 7.

In the preferred form of the invention, the side members 8 and 9 interface with the substantially vertically disposed side faces 30 of the second, supported structural member 4.

As shown in FIG. 2, in the preferred form of the structural hanger 5, first and second back members 10 and 11 are paired with the side members 8 and 9, the first back member 10 being connected to the first side member 8 and the second back member 11 being connected to the second side member 9.

Other alternate embodiments of the invention are possible where the structural hanger 5 is formed with only a single back member that is connected to one or both of the side members 8 and 9. In the preferred embodiment, the back members 10 and 11 are disposed away from the seat 7 with respect to the side members 8 and 9, but the back members 10 and 11 could be bent inwardly of the side members 8 and 9 and be disposed above the seat 7.

As shown in FIG. 1, in the preferred form of the present invention, the first and second back members 10 and 11 at least partially interface with the front surface 3 of the supporting structure 1.

As shown in FIG. 1, in the preferred form of the present invention, the first and second back members 10 and 11 interface with the front surface 3 of the supporting structure 1 near the edge 6 of the sup-porting structure 1, and interface with the front surface of the supporting structure 1 along their entire lengths.

As shown in FIG. 1, in the preferred form of the present invention, a first top flange 12 is connected to the first back member 10, and a second top flange 13 is connected to the second back member 11, and the first and second top flanges 12 and 13 rest on the top surface 2 of the supporting structure 1. In the preferred embodiment, the first and second top flanges 12 and 13 are substantially planar, each having a respective top surface 28 and 29.

Other alternate embodiments of the invention are possible where the structural hanger 5 is formed with only a single top flange that is connected to one or both of the back members 10 and 11. In the preferred embodiment, the top flanges 12 and 13 are disposed away from the seat 7 with respect to the side members 8 and 9, but the top flanges 12 and 13 could be bent inwardly of the side members 8 and 9 and be disposed more in-line with the seat 7.

As shown in FIG. 1, in the preferred form of the invention, the first and second side members 8 and 9 extend from the seat member 7 substantially to the elevation of the top flanges 12 and 13, thereby providing lateral support to the supported member or second structure 4 along substantially its entire height. In the preferred embodiment, the height of the supported structure 4 is substantially the same as the depth of the structural connector or hanger 5 as measured from the top flanges 12 and 13 to the seat 7.

In the preferred form of the invention, the top surface 2 and the front face 3 of the supporting member 1 are disposed orthogonally to each other. Thus, in the preferred form of the invention, the top portions of the back members 10 and 11 of the hanger 5 are disposed orthogonally to the top flanges 12 and 13 of the hanger 5. In the preferred form of the hanger 5, the top flanges 12 and 13 are joined to the back members 10 and 11 at first and second bends 14 and 15 that are tight radius orthogonal bends.

In order to enhance the rigidity of the structural hanger 5 at the first and second bends 14 and 15, first and second embossments 16 and 17 are formed in the material of the first and second back members 10 and 11 and the first and second top flanges 12 and 13 that extend through the first and second bends 14 and 15. The embossments 16 and 17 stiffen the bends 14 and 15 between the top flanges 12 and 13 and the back members 10 and 11, preventing flexing at the bends 14 and 15 which could result in movement of the supported member 4 or joist.

As shown in FIGS. 1, 4, 5 and 6, in the preferred embodiment, the embossments 16 and 17 are stepped or have two-tiers in the portions made in the top flanges 12 and 13. The top flange portions of the embossments 16 and 17 are stepped so as to reduce the profile of the top flanges 12 and 13 of the structural hanger 5.

The top flange portions of the embossments 16 and 17 are each formed with two distinct sections, a deep or first section 19 and a shallow or second section 20 that are connected to each other. Each section 19 or 20 is formed by deforming the material of the top flanges 12 or 13 to a generally uniform height or level above the top surfaces 28 or 29 of the top flanges 12 or 13. The sections 19 and 20 are divided by an abrupt transition area 27 where the level of the deep or first section 19 quickly descends to the level of the shallow or second section 20, creating two tiers or steps.

The deep sections 19, provide greater stiffening of the top flanges 12 and 13, since the material of the top flanges 12 and 13 is deformed to a greater extent. In the preferred embodiment, the material of the top flanges 12 and 13, used to make the deep sections 19 of the embossments 16 and 17, is displaced 1.5 times the material thickness of the part. Similarly, in the preferred embodiment, the material of the top flanges 12 and 13, used to make the shallow sections 20, is displaced 0.5 times the material thickness of the part.

As shown in FIG. 2, the top flange portions of the embossments 16 and 17 can extend from the bends 14 and 15 to the rear edges 21 and 22 of the top flanges 13 and 12 or extend for only a portion of the top flanges 12 and 13, although a substantial majority of the length. It is preferable to extend the embossments 16 and 17 to the rear edges 22 and 21 of the top flanges 12 and 13; however, in the preferred form of the invention, some of the embossment 16 and 17 stop short of the rear edges 22 and 21 to allow for the placement of fasteners 24 and thereby minimize the profile of the top flanges 12 and 13 in combination with fasteners 24. In the preferred embodiment, nail openings 31 are provided in the first and second top flanges 12 and 13 to help the installer to position the nails to prevent splitting of the first structural member 1, and to position the fasteners 24 with respect to the embossments 16 and 17 to minimize the profile of the top flanges 13 and 12.

Figure 4:
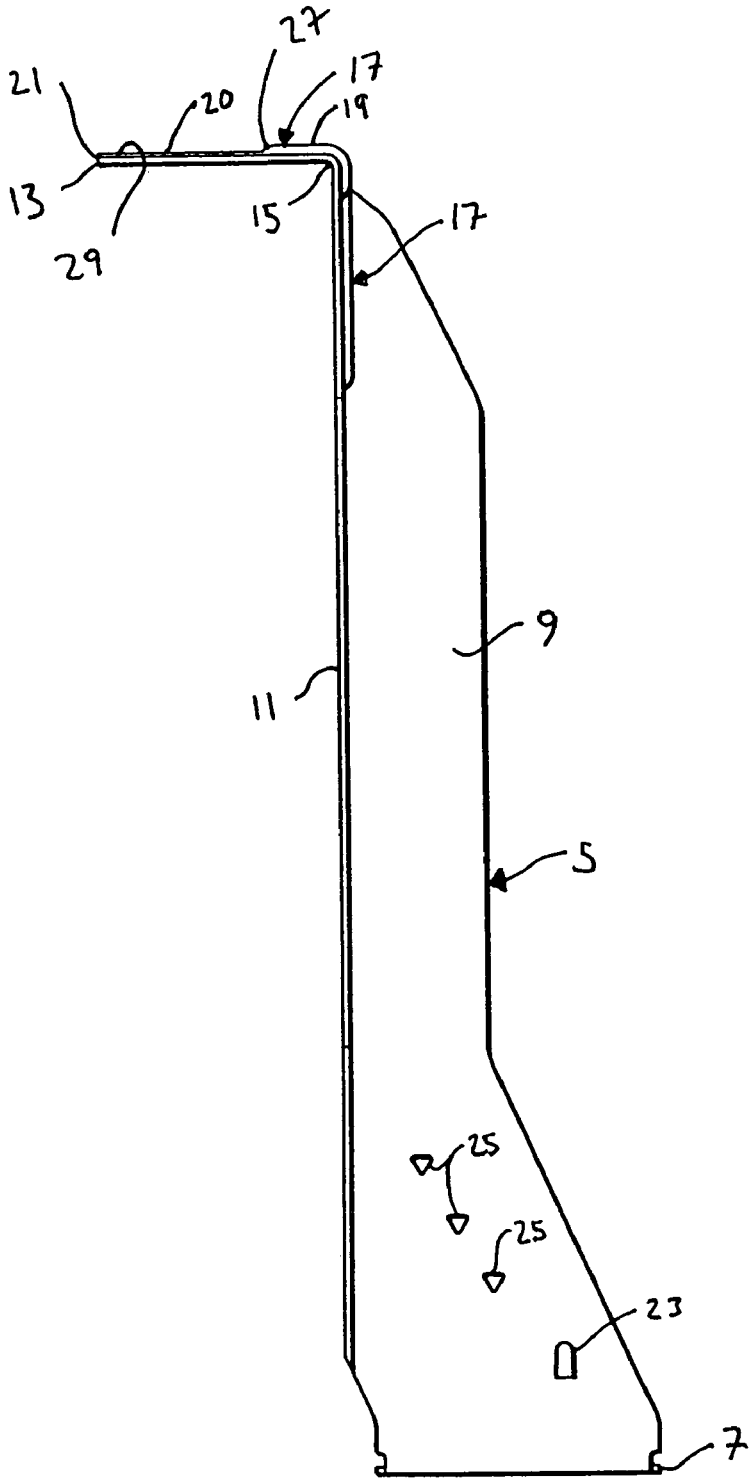
FIG. 4 is a side elevation view of the structural hanger of the present invention.
Figure 5:
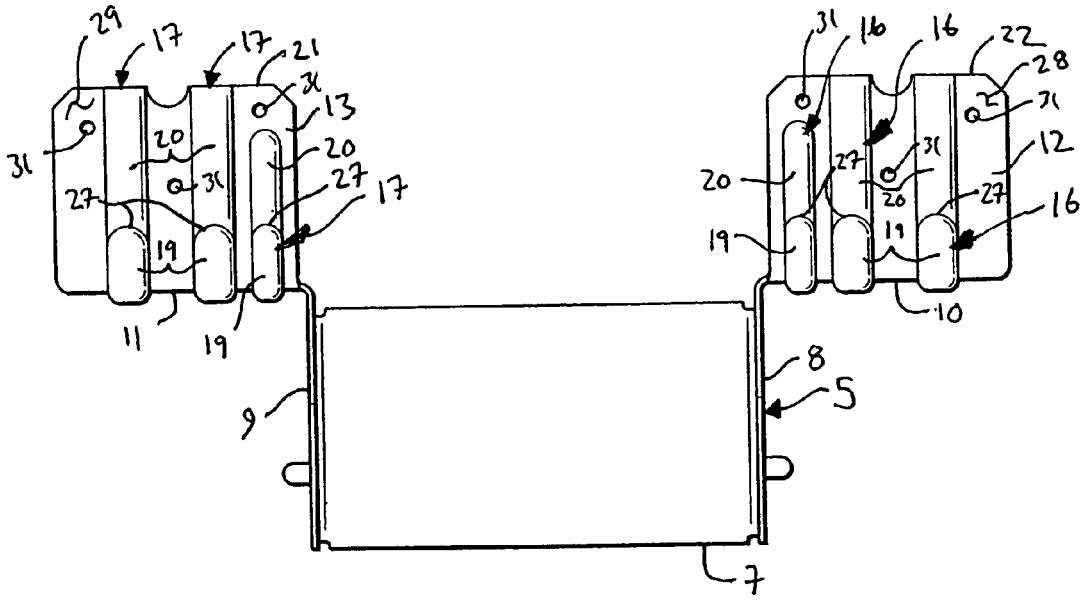
FIG. 5 is a top plan view of the structural hanger of the present invention.
Figure 6:
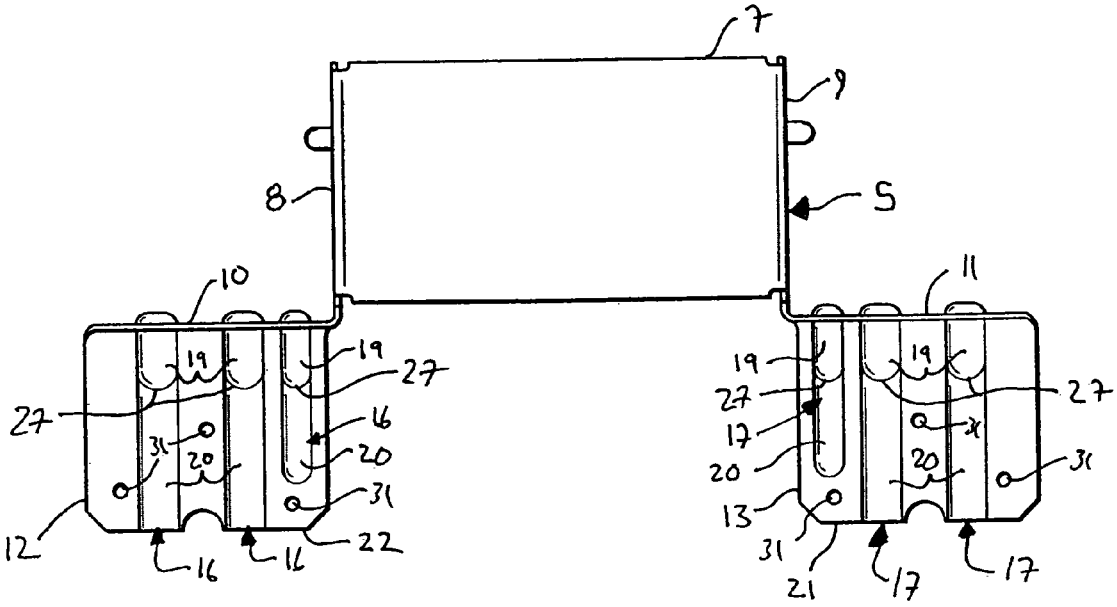
FIG. 6 is bottom plan view of the structural hanger of the present invention.

As shown in FIGS. 2 and 4, the deep sections 19 of the embossments 16 and 17 are disposed closer to the bends 14 and 15, where the structural hanger 5 is most likely to flex under load.

As is also shown in FIG. 2, the deep sections 19 of the embossments 16 and 17 extend only a select distance from the bends 14 and 15, so as to minimize the profile of the top flanges 12 and 13. In the preferred embodiment of the present invention, the deep sections 19 of the embossments 16 and 17 extend 0.75 inches from the bends 14 and 15, and the rear edges 21 and 22 of the top flanges 12 and 13 are set 2.5 inches form the bends 14 and 15. The inventors have found that extending the deep sections 19 of the embossments 16 and 17 approximately 0.75 inches from the bends 14 and 15 does not create reveal problems when a 14 gauge sheet metal hanger is used, the deep sections 19 of the embossments 16 and 17 are 1.5 times the material thickness of the part, the shallow sections 20 of the embossments 16 and 17 is 0.5 times the thickness of the part, the fasteners 24 used to attach the top flanges 12 and 13 to the supporting structure 1 are common 16 penny nails, and the shallow sections 20 of the embossments 16 and 17 are allowed to extend to the rear edges 21 and 22 of the top flanges 12 and 13 unless they would encounter one of the fasteners 24, in which case they stop short of overlapping the fastener 24. As shown in FIG. 2, three nail openings 31 and three embossments 16 or 17 are provided in each top flange 12 or 13 of the preferred embodiment.

As shown in FIGS. 2 and 4, in the preferred embodiment, the depth of the embossments 16 and 17 in the back members 10 and 11 is the same as the depth of the deep sections 19 of the embossments 16 and 17 in the top flanges 12 and 13.

As shown in FIG. 2, the back member portions of the embossments 16 and 17 can extend from the bends 14 and 15 variable distances. In the preferred embodiment the back member portions of the embossments 16 and 17 extend from 1 inches to 2⅜ inches from the bends 14 and 15.

The embossments 16 and 17 are preferably between ⅜ to ¼ inches wide, and preferably multiple embossments 16 or 17 are provided in each top flange 12 or 13. This allows for appropriate spacing of the fasteners 24 between multiple embossments 16 and 17, some of which, preferably two, extend the entire length of the top flanges 12 or 13, in the relatively narrow top flanges 12 and 13 such that no fastener 24 has to be driven through an embossment 16 or 17.

Figure 7:
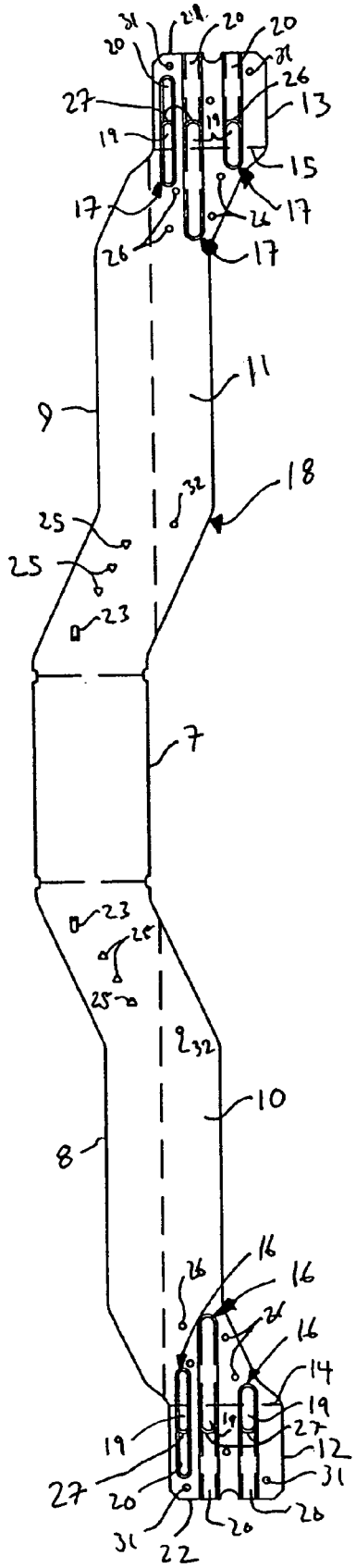
FIG. 7 is a plan view of a sheet metal blank from which the structural hanger of the present invention can be formed.

As shown in FIG. 7, in the preferred method of forming the structural hanger 5 of the present invention, the embossments 16 and 17 are formed in the blank, before the blank 18 is bent along bends 14 and 15.

The embossments 16 and 17 are made with male punches that are received in female openings. The same male punch is used to make the top flange portions and the back member portions of each embossment 16 or 17. The same male punch machined with two different heights is also used to make the deep section 19 and the shallow section 20 of each embossment 16 or 17.

It is preferred that the corresponding female opening for each male punch be specially shaped to match the height of the shallow section 20 of each embossment 16 or 17 to prevent the material forming the embossment 16 or 17 to extend above the selected height for the shallow section 20 of the embossment 16 or 17. The female opening does not need to be so specifically manufactured for accommodating the deep section 19 of the embossment 16 or 17 to make sure it does not exceed the selected height.

By forming the top flange portions of the embossments 16 and 17 with two distinct tiers or sections, automated die press machinery can be used to create strong deep sections 19 close to the bends 14 and 15 where strength is needed, and closely controlled shallow sections 20 can be made farther away from the bends 14 and 15, where strength is less important, and minimizing the height or profile of the top flange is more important. This ensures uniformity between parts, rigidity at the bends 14 and 15 and sufficiently strong but consistently thin top flange portions near the edges 22 and 21.

When the bends 14 and 15 are formed in the blank, the male form-punch for making the bends 14 and 15 is formed with raised supports at the selected height of the back member portions of the embossments 16 and 17 and the deep sections 20 of the top flange portions of the embossments 16 and 17 to keep the embossments from collapsing around the bends 14 and 15.

As shown in FIG. 1, in the preferred form of the hanger 5, slant nail openings 23 are provided in the side members 8 and 9 for driving fasteners 24 into the supported structure 4.

Figure 8:
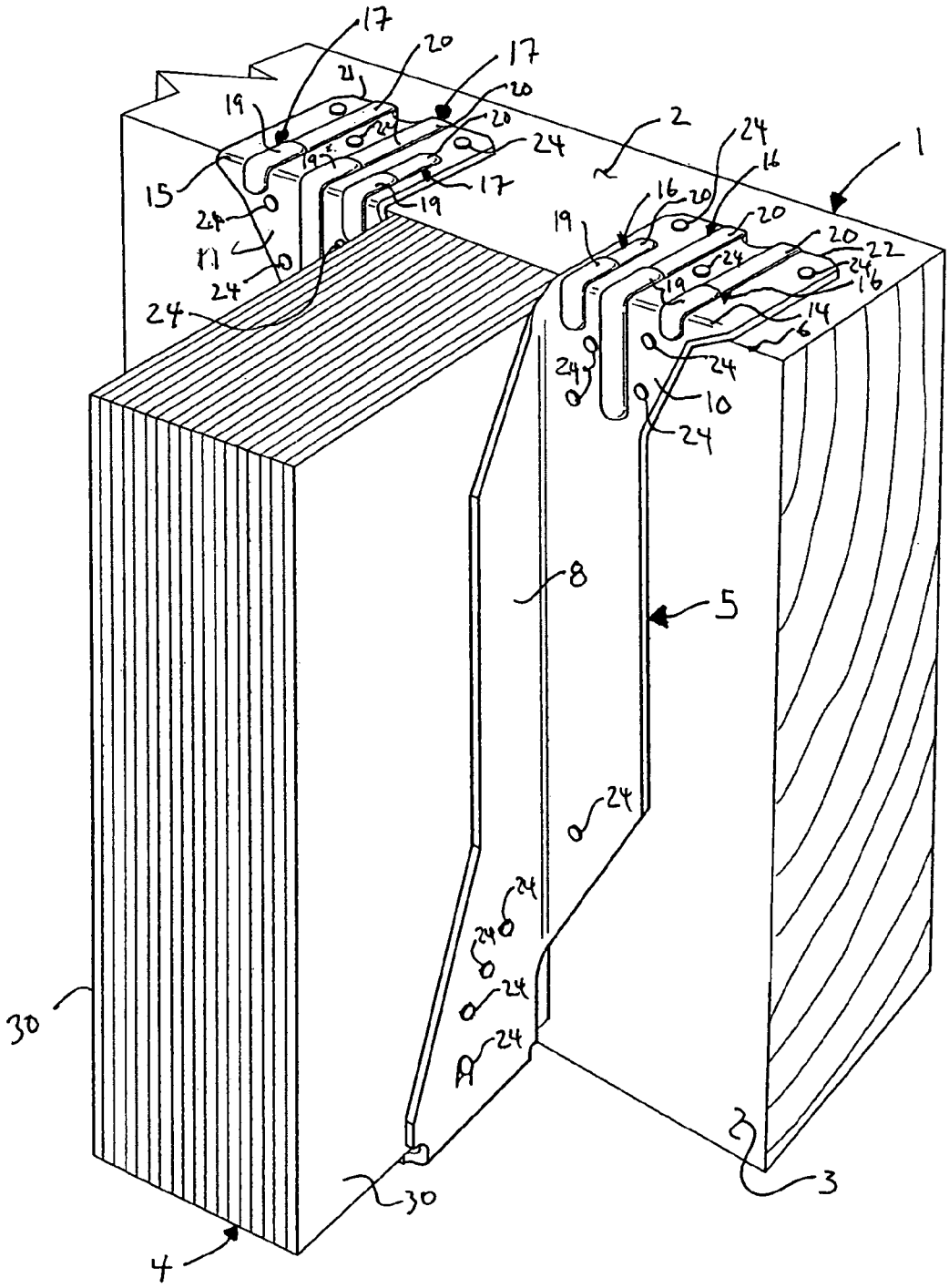
FIG. 8 is a perspective view of the structural hanger of the present invention mounted on a supporting structure, and holding a supported structure.

As is also shown in FIGS. 1 and 8, additional openings 25 can be formed in the side members 8 and 9 for receiving additional fasteners 24 that are driven through the side members 8 and 9 into the second structural member 4.

As shown in FIG. 1, in the preferred embodiment of the present invention, the fasteners 24 used to connect the structural connector 5 to the first and second structural members 1 and 3 are separate fasteners, specifically, appropriately sized nails for the loads that are desired to be achieved. However, other fasteners can be used such as screws, bolts, and adhesives. The structural connector 5 could also be welded to the first and second structural members 1 and 3, if it is not galvanized. The structural connector 5 could also be formed with integral fasteners such as nail prongs.

Figure 3:
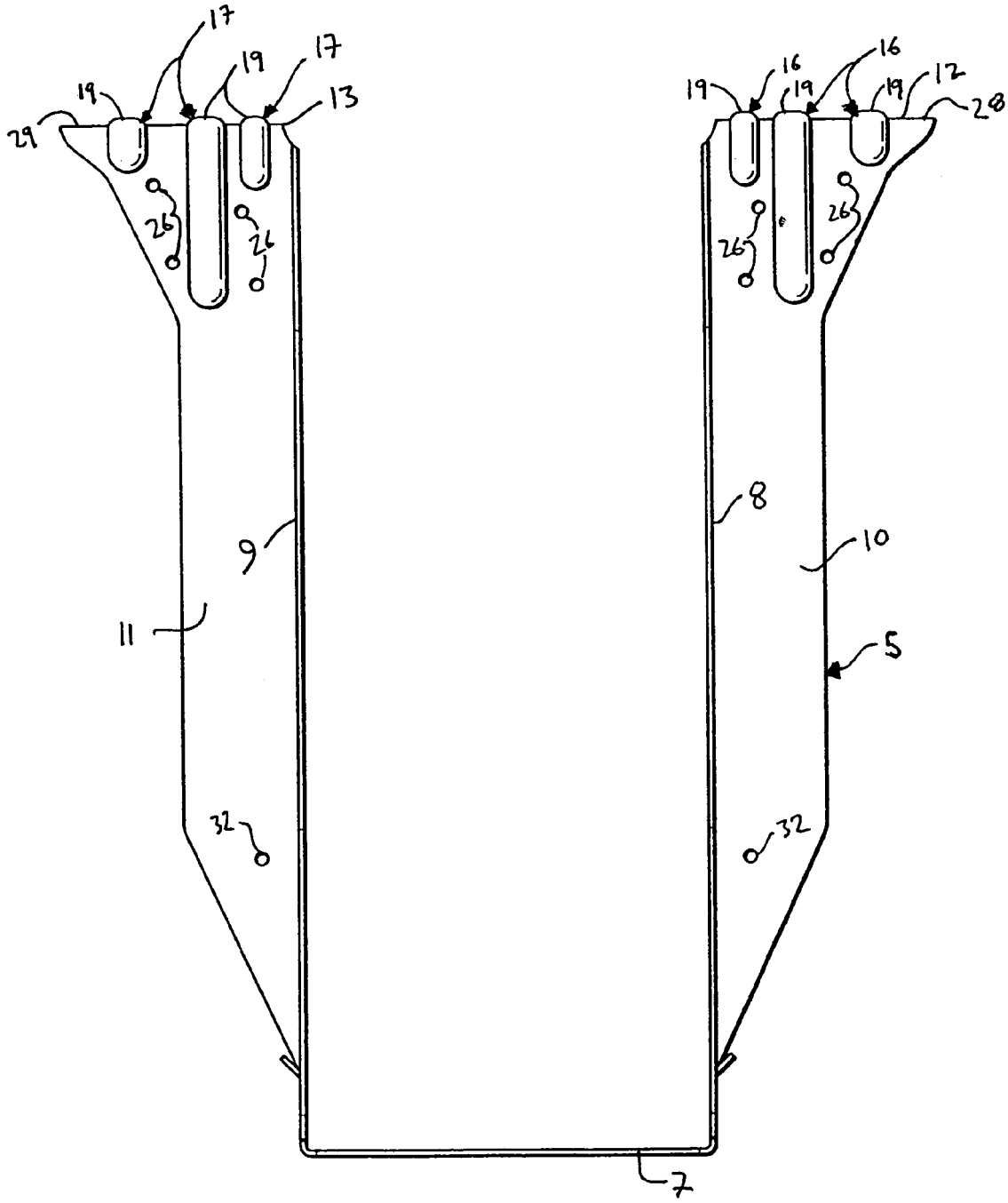
FIG. 3 is a front elevation view of the structural hanger of the present invention.

As shown in FIG. 3, in the preferred embodiment of the present invention, the back members 10 and 11 are provided with a plurality of nail openings 26 near the top of the back members 10 and 11 and near the bends 14 and 15. In the preferred embodiment of the present invention the back members 10 and 11 are wider where they approach the bends 14 and 15. Fasteners 24 are driven through the back members 10 and 11 into the supporting structure 3. As is also shown in FIGS. 1 and 3, the back members 10 and 11 are also formed with nail openings 32 near the bottom of the back members 10 and 11, that can receive additional fasteners 24 to increase the loads that the structural connector 5 can carry.

In the preferred form of the invention, at least one of the embossments 16 and 17 in each back member 10 and 11 extends below the level of the plurality of nail openings 26 near the top of the back members 10 and 11 and near the bends 14 and 15. Deflection forces are greatest around the group of fasteners 24 placed in these nail openings 26 near the top of the back members 10 and 11. In the preferred form of the invention, the plurality of nail openings 26 near the top of the back members 10 and 11 are approximately 2⅜ inches from the bends 14 and 15, but for relatively light gauge metal connectors 1 such as the preferred embodiment, the embossments 16 and 17 could extend as far as 4" from bends 14 and 15 to strengthen the connector 1 against deflection forces at bends 14 and 15 and the fasteners 24 near the bends 14 and 15.

Some examples of materials for the supported structure 4 and the supporting structure 1 include: solid-sawn wood, engineered wood products, laminated lumber, structural composite lumber, composite I-beams, trusses, stainless steel members, and multiple ply members of the various types listed above, with the preferred materials depending on the structural requirements of the building being erected, but generally being composite I-beams for the supported structure 4 and structural composite lumber or solid sawn lumber for the supporting structure 1. When fasteners such as nails or screws are used to connect the structural hanger to the supporting member, the supporting member could be a steel I-beam with a wood nailer member attached to the top of the I-beam.

The seat 7, side members 8 and 9, back members 10 and 11, and top flange 12 and 13 may be made in a variety of sizes.

In the preferred embodiment, the structural hanger 5 will be made from 14 gauge galvanized sheet metal (approximately 0.078 inches to 0.080 inches thick depending on the type of galvanizing), but the double, two-tiered embossment of the present invention should not be limited to this particular gauge. Structural hangers made from sheet metal as thin as 20 gauge material and as thick as 7 gauge material would benefit from the two-tiered embossment of the present invention.

We claim:

1. A structural connector for connecting first and second structural members, the structural connector comprising:

a. a first structural member;

b. a second structural member;

c. a first flange, having a top surface with a substantially planar portion, the first flange in operative connection with the first structural member such that forces imposed on the first flange can be transmitted to the first structural member, the first flange also being in operative connection with the second structural member such that forces imposed on the first flange can be transmitted to the second structural member; and d. an embossment in the substantially planar portion of the top surface of the first flange, wherein the embossment in the first flange is formed with first and second sections, the first section generally extending uniformly to a first level above the top surface of the substantially planar portion of the first flange, that is different from a level to which the second section generally uniformly extends above the top surface of the substantially planar portion of the first flange, the first and second sections being joined to each other at a distinct transition portion where the embossment descends from the level of the first section to the level of the second section.

2. The structural connector of claim 1, comprising:

a. a first member in operative connection with the second structural member and the first flange such that forces imposed on the second structural member are transmitted to the first member, and through the first member and then to the first flange, and through the first flange to the first structural member, the first flange being integrally connected to and differentiated from the first member at a first bend between the first flange and the first member; and b. the embossment in the first flange extends through the first bend into the first member.

3. The structural connector of claim 2, wherein:

a. the structural connector is a hanger;

b. the first flange of the structural connector is a first top flange that rests on a top surface of the first structural member;

c. the first member of the structural connector is a first back member that is at least partially disposed against a front surface of the first structural member.

4. The structural connector of claim 3, wherein the structural connector further comprises:

a first side member in operative connection with the first back member, the first side member being connected to the second structural member.

5. The structural connector of claim 4, wherein the structural connector further comprises:

a seat member in operative connection with the first back member, by means of the first side member, the seat member providing a bearing surface for the second structural member.

6. The structural connector of claim 5, further comprising:

separate fasteners for attaching the structural connector to the first structural member and the second structural member.

7. The structural connector of claim 6, wherein:
a. the first structural member is a joist support that is part of a structural frame of a building, and
b. the second structural member is a joist that is a part of the structural frame of the building.

8. The structural connector of claim 3, wherein the structural connector further comprises:
a seat member in operative connection with the first back member, the seat member providing a bearing surface for the second structural member.

9. The structural connector of claim 2, wherein:
the level of the first section of the embossment is higher than the level of the second section of the embossment, and the first section of the embossment is closer to the first bend between the first flange and the first member than the second section.

10. The structural connector of claim 2, wherein:
a. the first flange is made with a rear edge; and
b. the embossment of the first flange extends a substantial portion of the distance between the first bend and the rear edge of the first flange.

11. The structural connector of claim 2, wherein:
a. the first flange is made with a rear edge; and
b. the embossment of the first flange extends the distance between the first bend and the rear edge of the first flange.

12. The structural connector of claim 2, further comprising:
a. a second flange, having a top surface with a substantially planar portion, the second flange in operative connection with the first structural member such that forces imposed on the second flange can be transmitted to the first structural member;
b. a second member in operative connection with the second structural member and the second flange such that forces imposed on the second structural member are transmitted to the second member, and through the second member and then to the second flange, and through the second flange to the first structural member, the second flange being integrally connected to and differentiated from the second member at a second bend between the second flange and the second member; and
c. an embossment in the substantially planar portion of the top surface of the second flange that extends through the second bend into the second member, wherein the embossment in the second flange is formed with first and second sections, the first section generally extending uniformly to a first level above the top surface of the substantially planar portion of the second flange, that is different from a level to which the second section generally uniformly extends above the top surface of the substantially planar portion of the first flange, the first and second sections being joined to each other at a distinct transition portion where the embossment descends from the level of the first section to the level of the second section.

13. The structural connector of claim 12, wherein:
a. the structural connector is a hanger;
b. the first and second flanges of the structural connector are first and second top flanges that rest on a top surface of the first structural member;
c. the first and second members of the structural connector are first and second back members that are at least partially disposed against a front surface of the first structural member.

14. The structural connector of claim 13, wherein the structural connector further comprises:
a. a first side member in operative connection with the first back member, the first side member being connected to the second structural member; and
b. a second side member in operative connection with the second back member, the second side member being connected to the second structural member.

15. The structural connector of claim 14, wherein the structural connector further comprises:
a seat member in operative connection with the first and second back members, by means of the first and second side members, the seat member providing a bearing surface for the second structural member.

16. The structural connector of claim 15, further comprising: fasteners for attaching the structural connector to the first structural member and the second structural member.

17. The structural connector of claim 16, wherein:
a. the first structural member is a joist support that is part of a structural frame of a building, and
b. the second structural member is a joist that is a part of the structural frame of the building.

18. The structural connector of claim 13, wherein the structural connector further comprises:
a seat member in operative connection with the first and second back members, the seat member providing a bearing surface for the second structural member.

19. The structural connector of claim 12, wherein:
the level of the first sections of the embossments in the first and second flanges is higher than the level of the second sections of the embossments, and the first sections of the embossments in the first and second flange are closer to the first and second bends than the second sections of the embossments.

20. The structural connector of claim 12, wherein:
a. the first flange is made with a rear edge and the second flange is made with a rear edge; and
b. the embossment of the second flange extends a substantial portion of the distance between the second bend and the rear edge of the second flange, and the embossment of the first flange extends a substantial portion of the distance between the first bend and the rear edge of the first flange.

21. The structural connector of claim 12, wherein:
a. the first flange is made with a rear edge and the second flange is made with a rear edge; and
b. the embossment of the second flange extends the distance between the second bend and the rear edge of the second flange, and the embossment of the first flange extends the distance between the first bend and the rear edge of the first flange.

22. An apparatus, comprising:
a. a first structural member;
b. a second structural member;
c. a structural connector having,
1. a first flange, having a top surface with a substantially planar portion, the first flange in operative connection with the first structural member such that forces imposed on the first flange can be transmitted to the first structural member;
2. a first member in operative connection with the second structural member and the first flange such that forces imposed on the second structural member are transmitted to the first member, and through the first member and then to the first flange, and through the first flange to the first structural member, the first flange being integrally connected to and differentiated from the first member at a first bend between the first flange and the first member; and 3. an embossment in the substantially planar portion of the top surface of the first flange that extends through the first bend into the first member, wherein the embossment in the first flange is formed with first and second sections, the first section generally extending uniformly to a first level above the top surface of the substantially planar portion of the first flange, that is different from a level to which the second section generally uniformly extends above the top surface of the substantially planar portion of the first flange, the first and second sections being joined to each other at a distinct transition portion where the embossment descends from the level of the first section to the level of the second section.

23. The apparatus of claim 22, wherein:

a. the structural connector is a hanger;

b. the first flange of the structural connector is a first top flange that rests on a top surface of the first structural member;

c. the first member of the structural connector is a first back member that is at least partially disposed against a front surface of the first structural member.

24. The apparatus of claim 23, wherein the structural connector further comprises:

a first side member in operative connection with the first back member, the first side member being connected to the second structural member.

25. The apparatus of claim 24, wherein the structural connector further comprises:

a seat member in operative connection with the first back member, by means of the first side member, the seat member providing a bearing surface for the second structural member.

26. The apparatus of claim 25, further comprising:

separate fasteners for attaching the structural connector to the first structural member and the second structural member.

27. The apparatus of claim 26, wherein:

a. the first structural member is a joist support that is part of a structural frame of a building, and b. the second structural member is a joist that is a part of the structural frame of the building.

28. The apparatus of claim 22, wherein:

the level of the first section of the embossment is higher than the level of the second section of the embossment, and the first section of the embossment is closer to the first bend between the first flange and the first member than the second section.

29. The apparatus of claim 23, wherein the structural connector further comprises:

a seat member in operative connection with the first back member, the seat member providing a bearing surface for the second structural member.

30. The apparatus of claim 22, wherein:

a. the first flange is made with a rear edge; and b. the embossment of the first flange extends a substantial portion of the distance between the first bend and the rear edge of the first flange.

31. The structural connector of claim 22, wherein:

a. the first flange is made with a rear edge; and b. the embossment of the first flange extends the distance between the first bend and the rear edge of the first flange.

* * * * *